US011104488B2

(12) United States Patent
Kravchenko

(10) Patent No.: US 11,104,488 B2
(45) Date of Patent: Aug. 31, 2021

(54) NIPPLE CREAM APPLICATOR

(71) Applicant: Alina Kravchenko, Houston, TX (US)

(72) Inventor: Alina Kravchenko, Houston, TX (US)

( * ) Notice: Subject to any disclaimer, the term of this patent is extended or adjusted under 35 U.S.C. 154(b) by 0 days.

(21) Appl. No.: 16/540,638

(22) Filed: Aug. 14, 2019

(65) Prior Publication Data

US 2020/0071033 A1 Mar. 5, 2020

Related U.S. Application Data

(60) Provisional application No. 62/754,162, filed on Nov. 1, 2018.

(51) Int. Cl.

| | |
|---|---|
| ***B43M 11/06*** | (2006.01) |
| ***B65D 35/44*** | (2006.01) |
| ***B65D 47/08*** | (2006.01) |
| ***B65D 51/24*** | (2006.01) |

(52) U.S. Cl.
CPC ..... *B65D 35/44* (2013.01); *B65D 47/0838* (2013.01); *B65D 51/249* (2013.01)

(58) Field of Classification Search
CPC ..... A45D 40/261; A45D 34/041; A45D 2200/1009; A45D 2200/1018; B65D 47/42
USPC ..... 401/183, 209, 213, 262, 263, 265, 266
See application file for complete search history.

(56) References Cited

U.S. PATENT DOCUMENTS

| | | | | |
|---|---|---|---|---|
| 2,197,502 A | | 4/1940 | Lowen | |
| 2,474,969 A | | 7/1949 | Bengtson | |
| 2,557,221 A | | 6/1951 | Gazda | |
| 2,961,679 A | | 11/1960 | Claypool | |
| 3,075,229 A | | 1/1963 | Rufo | |
| 3,135,007 A | | 6/1964 | Howell | |
| 4,594,015 A | * | 6/1986 | Pomares | A46B 11/0041 401/139 |
| 4,739,906 A | | 4/1988 | LoTurco | |
| 4,940,350 A | * | 7/1990 | Kim | A45D 34/041 401/209 |
| 4,998,838 A | * | 3/1991 | Cancelosa | A45D 34/04 401/202 |
| 6,305,864 B1 | * | 10/2001 | Nguyen | B43K 23/04 15/435 |
| 6,913,407 B2 | * | 7/2005 | Greer | B05C 17/002 401/266 |
| 7,513,707 B2 | * | 4/2009 | Eggleden | A45D 27/04 401/153 |
| 2003/0077383 A1 | | 4/2003 | Greer | |
| 2008/0003052 A1 | * | 1/2008 | Lee | A45D 34/041 401/209 |

* cited by examiner

*Primary Examiner* — Jennifer C Chiang
(74) *Attorney, Agent, or Firm* — Scot S. Fagerland, Esq.

(57) ABSTRACT

This patent describes the application end of a dispenser, for applying a cream product from a squeeze tube. In its best mode, it is envisioned as a dispenser for nipple cream, for nursing mothers. The applicator has attachment means for securing the applicator to a squeeze-tube. The invention may include a squeeze tube, or alternatively an outer base to assist in retaining the invention on a squeeze tube. The cream product from the squeeze tube is directed through an outlet neck and then through a slit in a soft pad. The pad is useful for spreading cream evenly onto skin cleanly and comfortably. A cap forms a tight seal with the outer base to protect the pad and the contents of the tube. The cap may be attached to the outer base with a connector. Alternatively, the cap may be attached to a suction cup.

13 Claims, 8 Drawing Sheets

NIPPLE CREAM APPLICATOR

1. FIELD OF THE INVENTION

This invention relates to a dispenser, in particular the application end of the dispenser, for applying a cream product from a squeeze tube.

2. BACKGROUND OF THE INVENTION

This product is for the dispensation of a liquid, cream, or paste from a squeeze tube. Its best mode of use is as a nipple cream applicator. Nursing mothers often apply cream to their nipples to protect sensitive skin during breastfeeding. Conventionally, a mother applies nipple ointment with her fingers. If she does not wash her hands properly, this can cause an eruption or infection, which can be transferred to the nursing infant. Nipple cream ointment is sticky and water resistant, making it hard to clean from the fingers. Common makeshift applicators include paper towels and cotton swabs. There is no known product dedicated to nipple cream application.

3. DESCRIPTION OF RELATED TECHNOLOGY

Several patents disclose applicators for liquids, creams, or pastes from squeeze tubes. None of them are specifically designed for nipple cream application, which has certain design requirements.

Stanley Lowen (U.S. Pat. No. 2,197,052) discloses a combination squeeze tube and applicator pad, which is all integrated into one unit. The applicator pad has a slit, which is a narrow opening extending from the opening of the tube to the surface of the pad. When the tube is squeezed, material from the tube flows through the slit and onto the pad. Because the applicator is integrated with the squeeze tube, it is not reusable. After the tube is empty, the whole assembly must be discarded and replaced with a new one. Lowen does not use a cap, and in fact he argues against one: "A separate closure cap or element is not necessary." (Column 2 lines 19-24).

Bengston (U.S. Pat. No. 2,474,969) provides an applicator member separable from and attachable to a squeeze tube. The applicator is fitted with internal threads, which engage with outer threads on the neck of the squeeze tube. The applicator is topped with a plastic or rubber flange. When the tube is squeezed, its contents are released through a slit ("outlet") into a "concave face" on the exterior of the flange. Product is then applied from the concave face reservoir to the skin. A separate item disclosed in this patent is the closure means, which is placed over the applicator component when the product is not in use. A stem with enlargement protrudes through the outlet to keep the tube airtight. A first disadvantage of this product is the absence of a pad. A hard plastic or rubbery surface is not comfortable on nipples. A second disadvantage is that the closure means is not attached to the applicator member. Handling two separate components requires both hands, and the components are more susceptible to loss than if integrated.

An airtight-seal cap attached to the dispenser is disclosed in LoTurco (U.S. Pat. No. 4,739,906). This product includes a cap retaining ring for securing the device to a squeeze tube for dispensation, and a cap for sealing the tube when not in use. The cap is attached to the cap retaining ring with an "integral living hinge." The invention as disclosed in LoTurco is envisioned as a dispenser for liquids such as contact lens cleaning solutions. It does not offer any kind of padding for sensitive tissue or for distributing cream product over skin.

Other patents, as disclosed in this patent application, combine features of the products above.

What is needed is an applicator that is not integrated with a squeeze tube but is adapted to attach to one, with a soft pad for dispensing cream to the skin, sealed by a cap that is attached to the applicator.

4. SUMMARY OF THE INVENTION

This invention provides an applicator for applying a cream product from a squeeze tube dispenser onto skin. In its best mode, it is envisioned as an applicator for nipple cream.

In alternative embodiments, the invention may include a squeeze tube or may constitute an applicator adapted to fit onto a squeeze tube. The applicator has attachment means for securing the applicator to a squeeze tube. The attachment means may take the form of screw threads or snap-and-lock tabs. The invention has a lower base, which assists in retaining the invention on a squeeze tube.

The cream product from the squeeze tube is directed through a dispensing neck and then through a slit in a soft pad. The pad is useful for spreading cream evenly onto skin cleanly and comfortably.

A cap forms a tight seal with the lower base to protect the pad and the contents of the tube. The cap may be attached to the lower base with a connector. Alternatively, the cap may be attached to a suction cup, holding it in place so that the squeeze tube and pad may be quickly inserted or removed from the cap.

5. BRIEF DESCRIPTION OF THE DRAWINGS

FIG. 1 shows the invention secured to a squeeze tube. In this drawing, the cap is attached to the lower base, and the cap is open. The squeeze tube, shown in broken lines, is not claimed as part of this embodiment.

FIG. 2 shows the invention secured to a squeeze tube. In this drawing, the cap is closed. The squeeze tube, shown in broken lines, is not claimed as part of this embodiment.

Figures 1, 2:
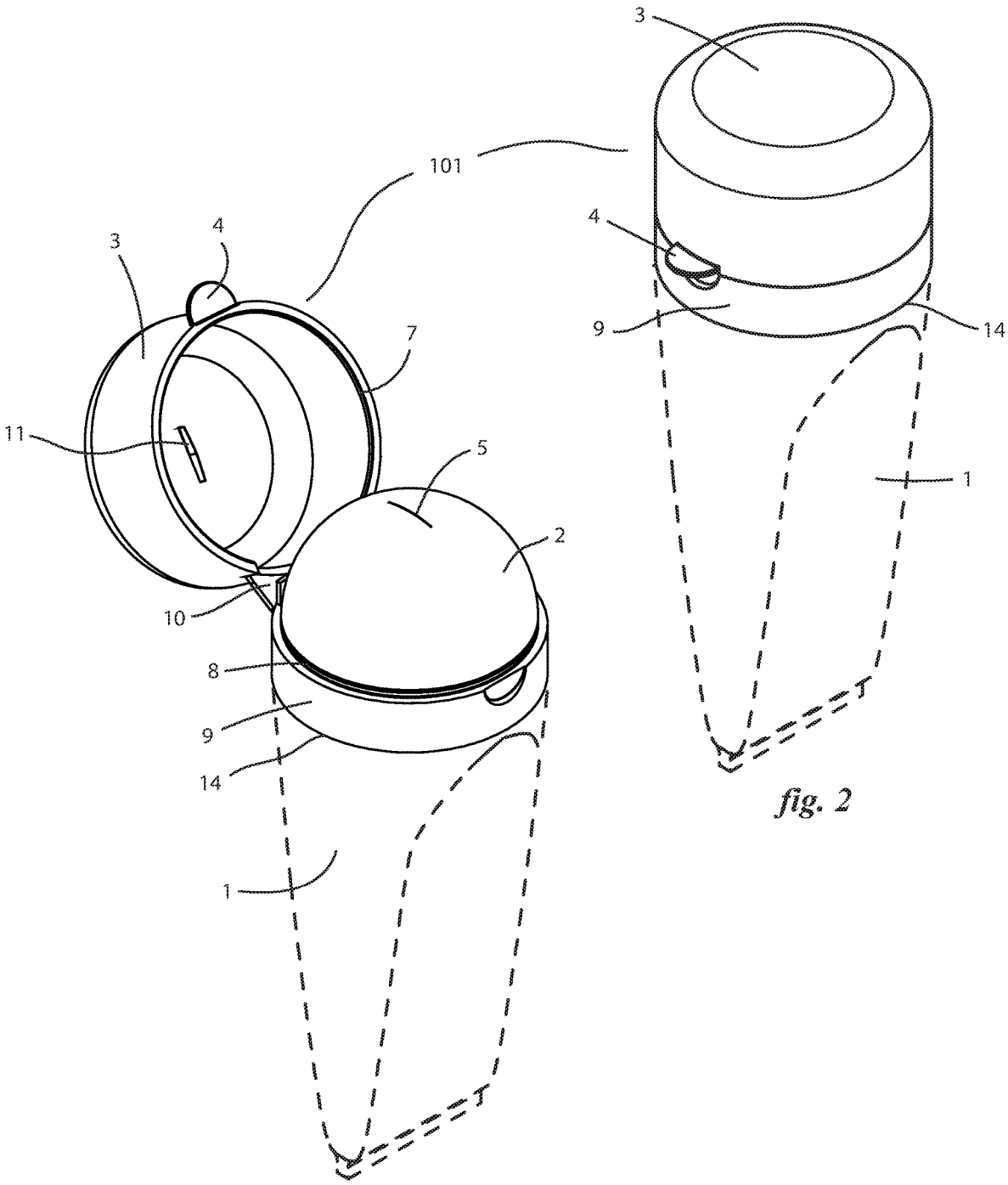
Figure 4:
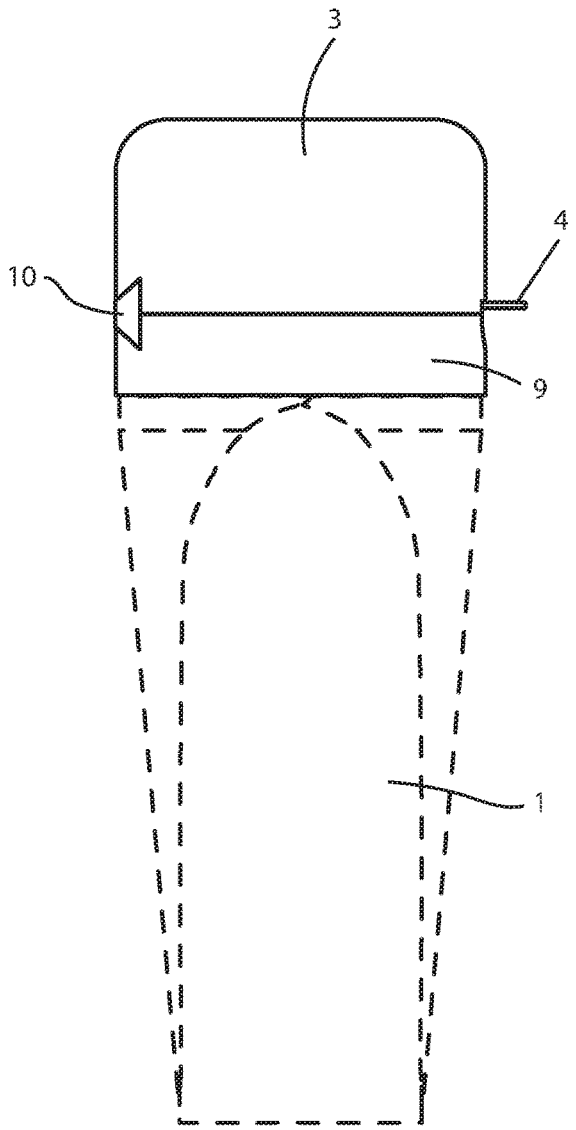
FIG. 4 is a left view of the invention with the cap closed. The squeeze tube, shown in broken lines, is not claimed as part of this embodiment.
Figure 3:
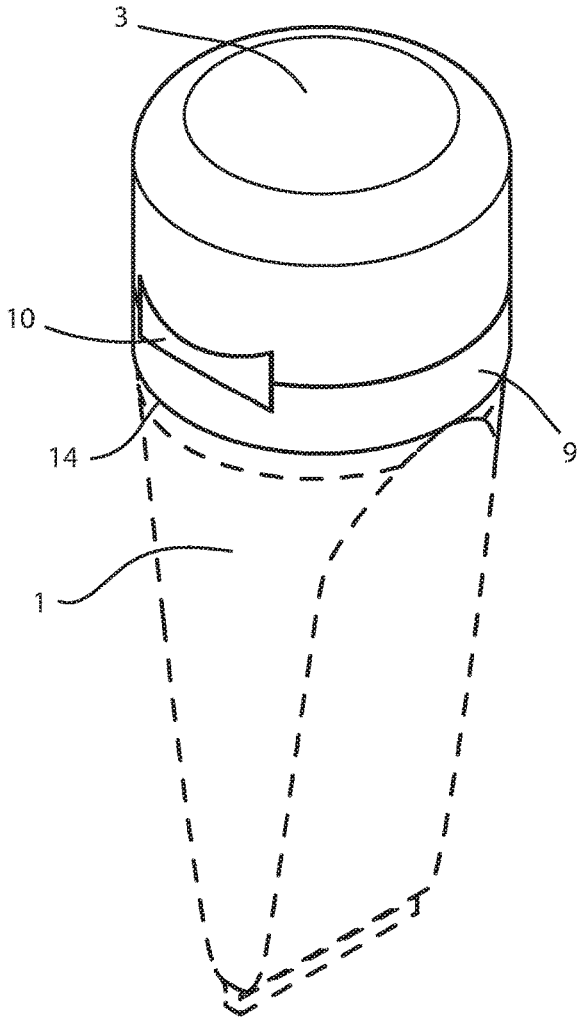
FIG. 3 shows the invention secured to a squeeze tube, viewed from an angle diametrically opposed to FIG. 2. The squeeze tube, shown in broken lines, is not claimed as part of this embodiment.
Figure 5:
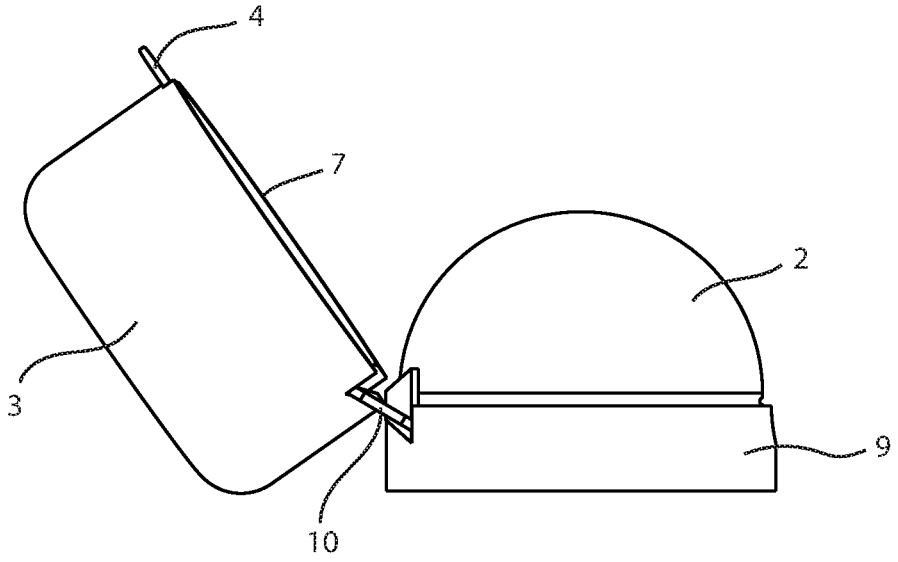
FIG. 5 is a left view of the invention with the cap open.
Figure 6:
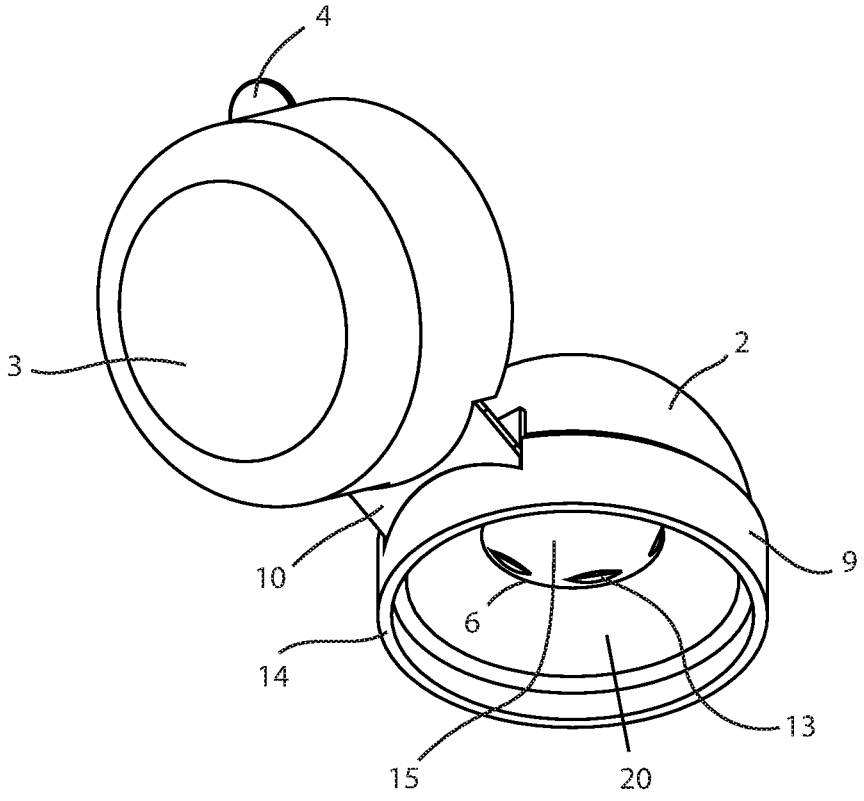
FIG. 6 is a perspective view of the invention with the cap open, showing tabs in the hollow interior space of the base of the invention.
Figure 7:
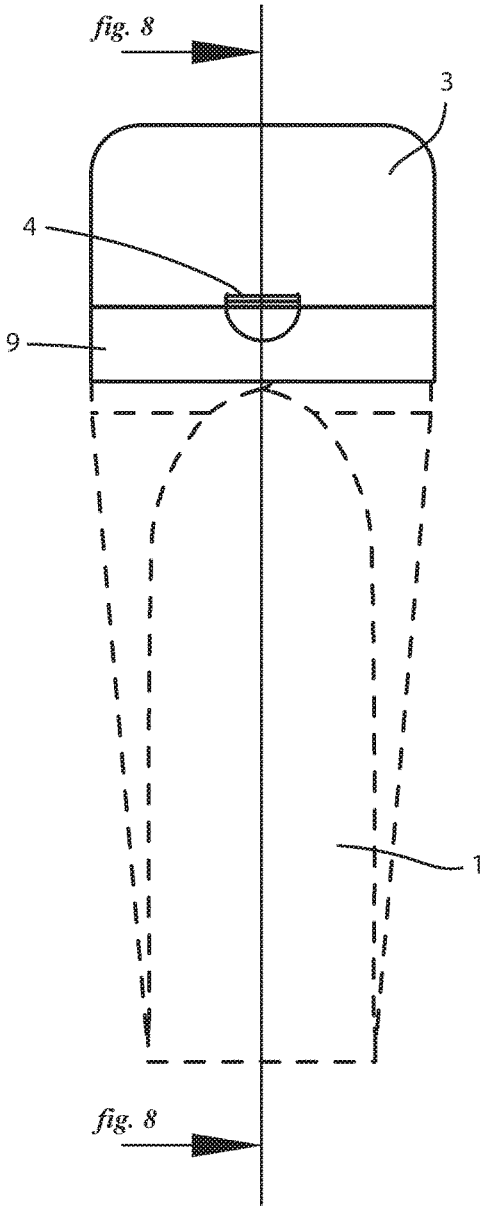

FIG. 7 is a front view of the invention with the cap closed, secured to a squeeze tube. A plane cut through FIG. 7 is used as reference for FIG. 8. The squeeze tube, shown in broken lines, is not claimed as part of this embodiment.

Figure 8:
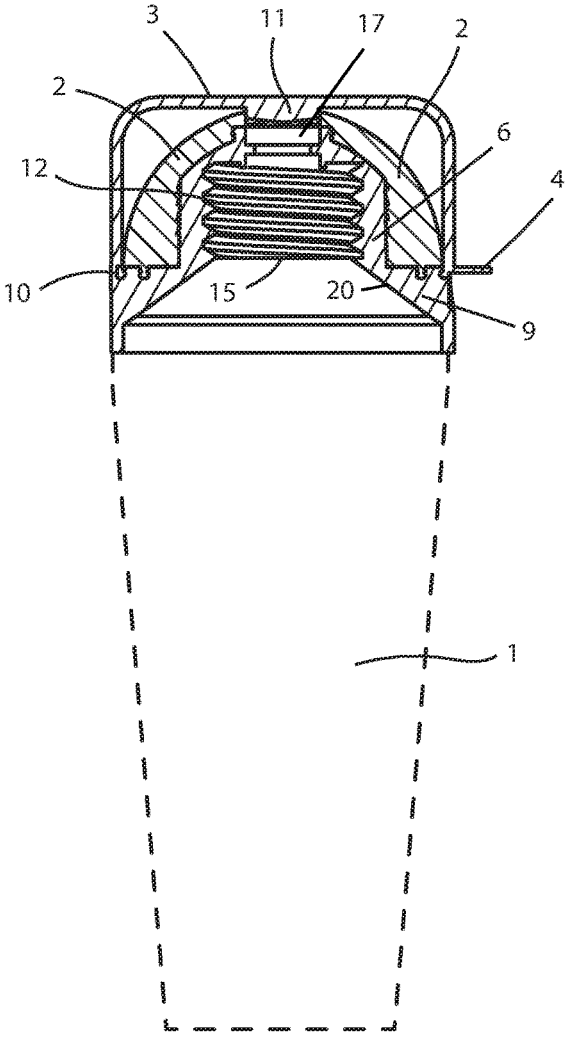

FIG. 8 is a left cross-sectional view of the invention with screw threads, viewing the plane cut through FIG. 7. The squeeze tube, shown in broken lines, is not claimed as part of this embodiment.

Figure 9:
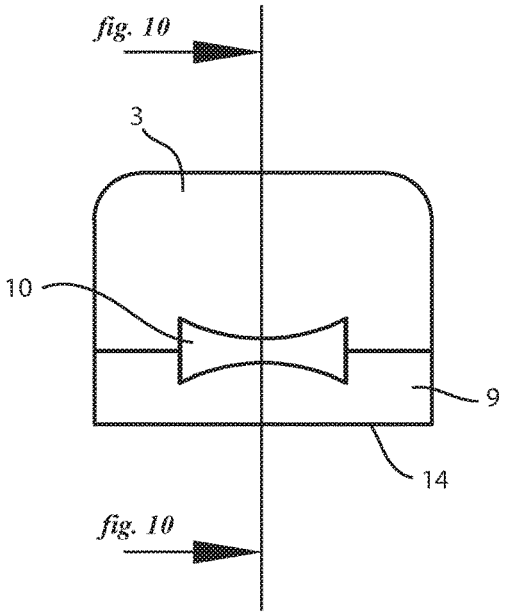

FIG. 9 is a back view of the invention with the cap closed. A plane cut through FIG. 9 is used as reference for FIG. 10.

Figure 10:
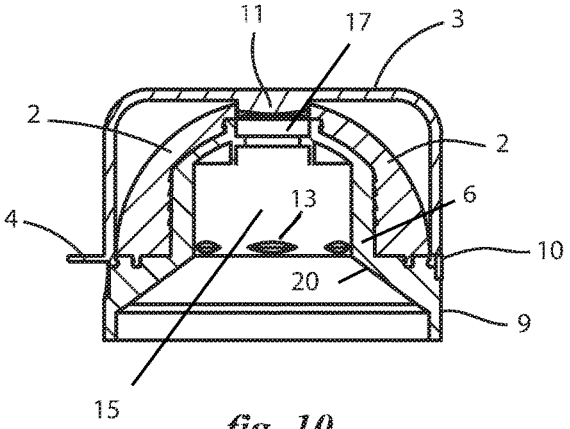

FIG. 10 is a right cross-sectional view of the invention with snap-and-lock tabs, viewing the plane cut through FIG. 9.

Figure 11:
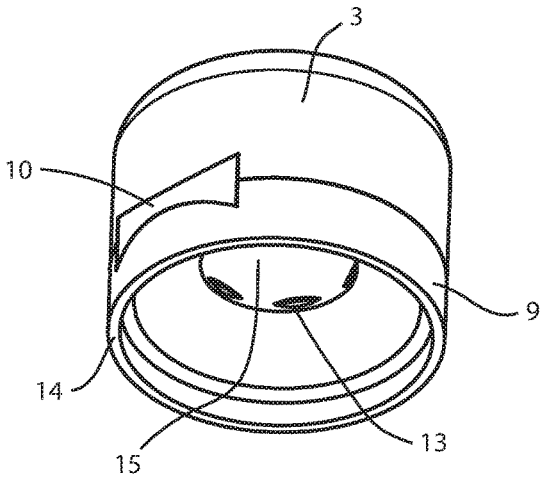

FIG. 11 is a perspective view of the invention with the cap closed. This view shows snap-and-lock tabs in the hollow interior space.

Figure 12:
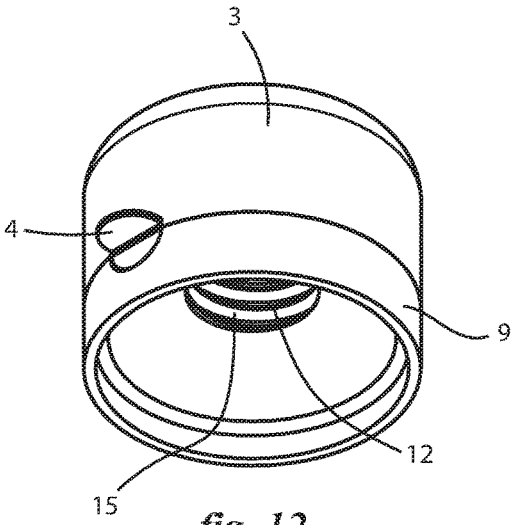

FIG. 12 is a perspective view of the invention with the cap closed. This view shows screw threads in the hollow interior space.

Figure 13:
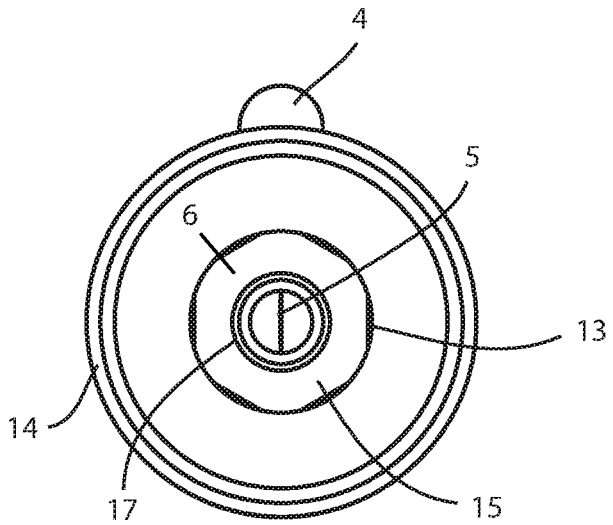

FIG. 13 is a bottom-plan view of the invention with snap-and-lock tabs.

Figure 14:
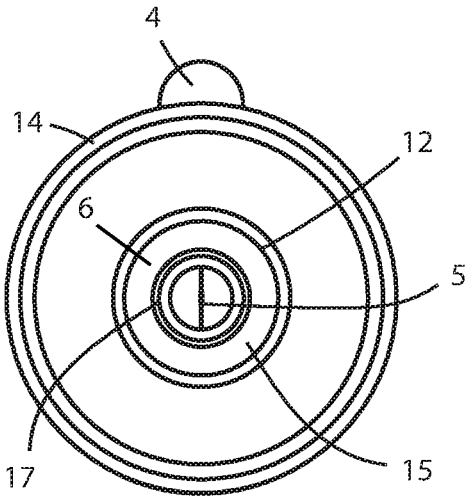

FIG. 14 is a bottom-plan view of the invention with screw threads.

Figure 15:
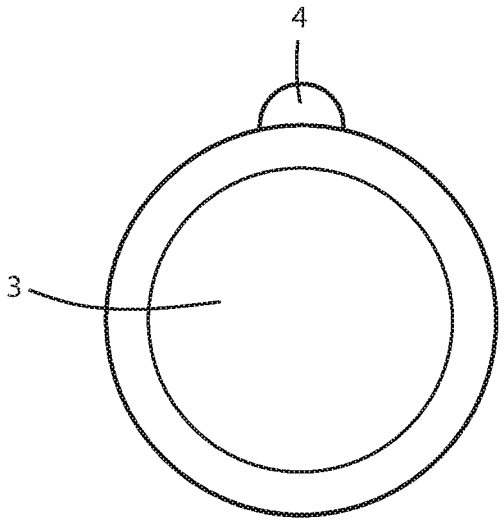

FIG. 15 is a top-plan view of the invention with the cap closed.

Figure 16:
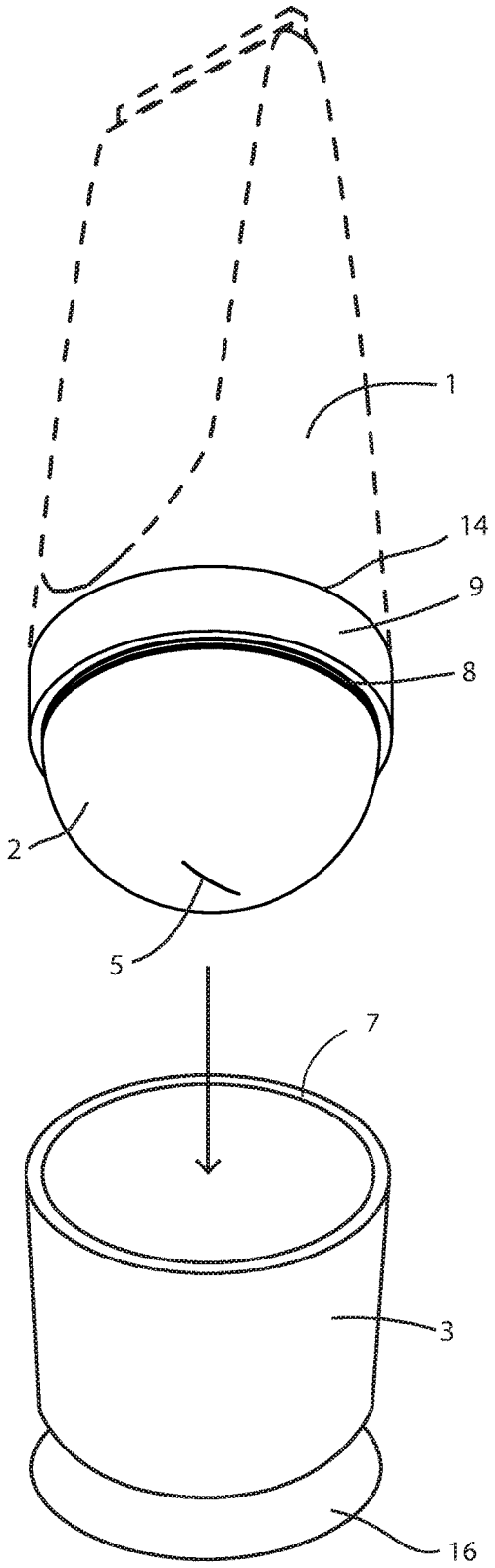

FIG. 16 shows an embodiment of the invention with a suction cup base lid. In this figure, the applicator is detached from the suction cup base lid. The arrow shows the direction of motion to attach the applicator to the suction cup base lid. The squeeze tube, shown in broken lines, is not claimed as part of this embodiment.

Figure 17:
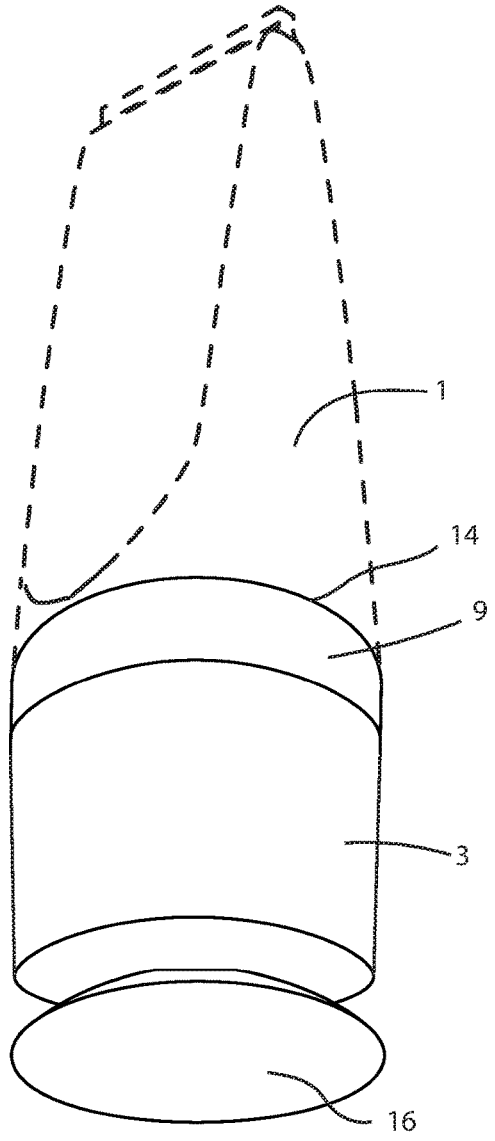

FIG. 17 shows the same embodiment of the invention as in FIG. 16. In this figure, the applicator is attached to the suction cup base lid. The squeeze tube, shown in broken lines, is not claimed as part of this embodiment.

Figure 18:
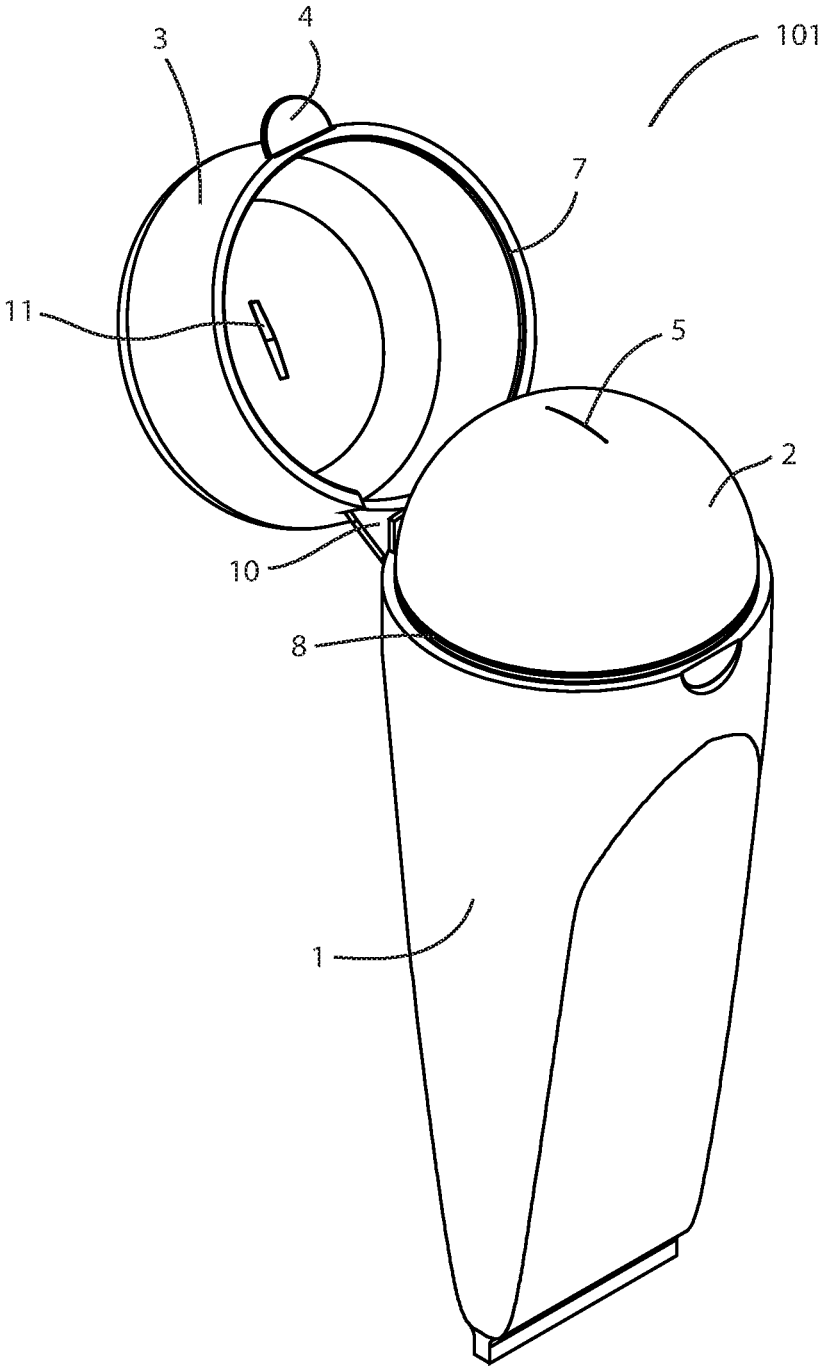

FIG. 18 presents an embodiment of the invention that integrates a squeeze tube.

6. DETAILED DESCRIPTION OF THE PREFERRED EMBODIMENTS

This invention relates primarily to a dispenser 101 that is adapted for use with a squeeze tube 1 for dispensing products such as nipple cream. FIGS. 1-7 depict several views of an embodiment of the invention in which the squeeze tube is not integrated with the dispenser 101. FIG. 18 shows another embodiment of the invention, in which the squeeze tube is permanently integrated with the dispenser. Each embodiment offers different advantages. A dispenser that is securable, but not permanently attached, to the squeeze tube provides the advantage of making the dispenser reusable. On the other hand, a product that features a unitary squeeze tube and dispenser is more durable and airtight.

A clear exterior view of the dispenser is afforded in FIGS. 1-5. Pad 2 is the surface that applies cream to the skin. For this reason, and because the invention is ideally for nipple cream, the pad is preferably made of a very soft, smooth material such as a cloth cushion. However, for durability and convenience of construction, the pad can also be made of a rigid material. Slit 5 in the pad is the opening where cream from the tube is dispensed. Thus, the pad is the surface where the cream is dispensed as well as the surface that applies the cream to the skin.

The pad is attached to, and supported by, a base 20 made of a rigid (ideally plastic) material. The base is revealed in FIG. 6 and in the cutaway views, FIGS. 8 and 10. The base is approximately bell-shaped, comprising an upper base 6 and a lower base 9. The lower base 9 (best seen in FIGS. 1 and 6) is approximately ring-shaped, with a base rim 8.

A cap 3 fits over the pad 2 to protect the pad and the cream contents of the tube. When the product is not being used to dispense cream, the cap is closed to help preserve the contents of the squeeze tube. The cap has a cap rim 7, which contacts the base rim 8 when the cap is closed (see FIGS. 1 and 2). The cap does not have to be permanently attached to the lower base 9, but optionally a connector 10 connects the cap 3 to the lower base 9.

For ease of opening, the cap has a thumb flap 4. When the user is ready to use the product, she may push up on thumb flap 4 and then dispense the product with the same hand. At no time does she need to touch the nipple cream or use both hands to fumble with the cap.

For further protection, cleanliness, and efficiency, a seal 11 is mounted to the cap 3. The seal is positioned so that it seals the slit 5 when the cap is closed.

FIGS. 8 and 10 are cross-sectional views showing the interior of the dispenser. Lower base 9 is attached to upper base 6, together comprising base 20. The upper base is coaxial to the lower base. The upper base has a smaller radius than the lower base. Pad 2 is attached to both the upper base and the lower base. These cross-sectional figures show the seal 11 penetrating the slit in the pad, forming an airtight seal with the dispensing neck 17. Thus, the cap protects not only the pad but also the cream contents of the tube.

The base 20 has a hollow interior space 15, which accommodates the squeeze tube 1. The hollow interior space 15 is best seen in FIGS. 6 and 11-14. The interior surface of the upper base has attachment means, which face the hollow interior space and are used to attach the dispenser 101 to the squeeze tube 1. Two examples of attachment means are screw threads 12 and snap-and-lock tabs 13. FIGS. 6, 10, 11, and 13 show a plurality of snap-and-lock tabs 13 that are used to secure the neck of a squeeze tube within the hollow interior space 15. FIGS. 8, 12, and 14 show screw threads 12 that are used to secure the neck of a squeeze tube within the hollow interior space.

The upper end of the hollow interior space 15 is a dispensing neck 17, best seen in cross-sectional FIGS. 8 and 10. The dispensing neck is adapted to accommodate the tip of standard-production squeeze tubes. The content of the tube, such as nipple cream, is dispensed directly from the tip of the squeeze tube into the dispensing neck 17, then through slit 5 onto the exterior of pad 2.

FIGS. 16 and 17 show an alternative embodiment of the invention that lacks connector 10. Instead, the cap 3 has a suction cup 16, which secures to a surface such as a tabletop and allows the cap to stand upright. In this mode, when the invention is not in use, the pad 2 is placed downward into the cap 3 and snapped into place so that the cap rim 7 makes close contact with the base rim 8. When the user is ready to apply product, she releases the dispenser from the cap—again, quickly and easily with one hand.

FIG. 18 shows the embodiment in which the squeeze tube 1 is integrated with the dispenser. In this embodiment, the base rim 8 is part of the squeeze tube 1, so it may alternatively be called a tube rim.

I claim:

1. A dispenser adapted to fasten to a squeeze tube for cream product, comprising:

a base made of a rigid material with a radially symmetric bell shape, said base having an axis of symmetry, an interior surface, a hollow interior space, and an exterior surface;

said base comprising a lower base and an upper base;

said upper base attached to the lower base, with the upper base and lower base sharing the exterior surface, the interior surface, the hollow interior space, and the axis of symmetry of the base;

said lower base comprising a base rim;

attachment means affixed to the interior surface of the upper base, for attaching the dispenser to a squeeze tube;

a dispensing neck extending from the hollow interior space of the upper base, for accommodating the tip of the squeeze tube;

a pad covering the entire exterior surface of the base;

a slit in the pad, situated over the dispensing neck;

and a cap to enclose the pad, said cap comprising a thumb flap, a cap rim for contacting the base rim, and a connector to connect the cap to the lower base.

2. The dispenser of claim 1, wherein the attachment means are screw threads.

3. The dispenser of claim 2, further comprising a seal protruding from the cap, said seal adapted to fit into the slit when the cap is closed.

4. The dispenser of claim 1, wherein the attachment means are snap-and-lock tabs.

5. The dispenser of claim 4, further comprising a seal protruding from the cap, said seal adapted to fit into the slit when the cap is closed.

6. The dispenser of claim 1, further comprising a seal protruding from the cap, said seal adapted to fit into the slit when the cap is closed.

7. A dispenser adapted to fasten to a squeeze tube for cream product, comprising:

a base made of a rigid material with a radially symmetric bell shape, said base having an axis of symmetry, an interior surface, a hollow interior space, and an exterior surface;

said base comprising a lower base and an upper base;

said upper base attached to the lower base, with the upper base and lower base sharing the exterior surface, the interior surface, the hollow interior space, and the axis of symmetry of the base;

said lower base comprising a base rim;

attachment means affixed to the interior surface of the upper base, for attaching the dispenser to a squeeze tube;

a dispensing neck extending from the hollow interior space of the upper base, for accommodating the tip of the squeeze tube;

a pad covering the entire exterior surface of the base;

a slit in the pad, situated over the dispensing neck;

and a cap to enclose the pad, said cap comprising a suction cup and a cap rim for contacting the base rim.

8. The dispenser of claim 7, wherein the attachment means are screw threads.

9. The dispenser of claim 7, wherein the attachment means are snap-and-lock tabs.

10. A squeeze tube and dispenser for cream product, comprising:

a base made of a rigid material with a radially symmetric bell shape, said base having an interior surface and an exterior surface;

a squeeze tube comprising a container portion for containing a cream product and a tip for dispensing the cream product;

said tip permanently affixed to the interior surface of the base;

a pad covering the entire exterior surface of the base;

and a slit in the pad, situated over the tip.

11. The squeeze tube and dispenser for cream product of claim 10, further comprising a tube rim on the container portion of the squeeze tube;

a cap to enclose the pad, said cap comprising a thumb flap, a cap rim for contacting the tube rim, and a connector to connect the cap to the lower base.

12. The squeeze tube and dispenser for cream product of claim 11, further comprising a seal protruding from the cap, said seal adapted to fit into the slit when the cap is closed.

13. The squeeze tube and dispenser for cream product of claim 10, further comprising a tube rim on the container portion of the squeeze tube;

a cap to enclose the pad, said cap comprising a suction cup and a cap rim for contacting the tube rim.

* * * * *